United States Patent [19]

Zelins

[11] 4,282,951

[45] Aug. 11, 1981

[54] GAFF GUARD FOR LINEMEN'S CLIMBERS

[75] Inventor: Ronald P. Zelins, Rockaway, Township, Morris County, N.J.

[73] Assignee: Western Electric Company, Inc., New York, N.Y.

[21] Appl. No.: 163,111

[22] Filed: Jun. 26, 1980

[51] Int. Cl.[3] ..... A63B 27/02

[52] U.S. Cl. ..... 182/221; 182/134

[58] Field of Search ..... 182/221, 134

[56] References Cited

U.S. PATENT DOCUMENTS

| | | | |
|---|---|---|---|
| 1,931,823 | 10/1933 | Hushour | 182/221 |
| 2,296,074 | 9/1942 | Weed | 182/221 |
| 2,419,363 | 4/1947 | Minney | 182/221 |
| 2,497,710 | 2/1950 | Wollensack | 182/221 |
| 2,870,947 | 1/1959 | Hendry | 182/221 |

OTHER PUBLICATIONS

Mathias Klein & Sons, Inc., Catalogs 1945-G, 1968-G, p. 17.

*Primary Examiner*—Reinaldo P. Machado

*Attorney, Agent, or Firm*—R. F. Kip, Jr.

[57] ABSTRACT

A gaff guard 30 for protecting the gaff 20 of a lineman's climber 10 having a leg iron 11 to which the gaff is secured comprises a body of synthetic resinous material having parts comprising, a scabbard 31 having a hollow interior 37 for receiving the point 22 of the gaff, a clip 32 adapted to straddle transversely opposite sides of leg iron 11 at a location above gaff 20 and to there attach to leg iron 11 by a snap-on action such that tabs 67 of the clip make contact with the back face of leg iron 11, and a resilient stem 33 coupling together scabbard 31 and clip 32 in fixed spatial relation when the stem is resiliently unstressed. Stem 33 is joined to scabbard 31 inwards of the outer side thereof and, moreover, is transversely offset from the centerline 48 of interior 37 to permit the stem to lie to one transverse side of the base 21 of the gaff when guard 30 is in use.

7 Claims, 8 Drawing Figures

FIG. 2
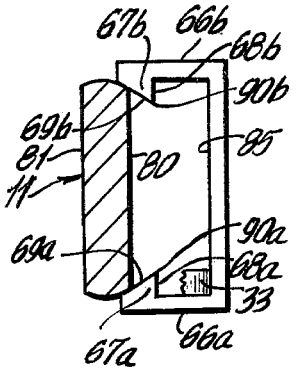
FIG. 3
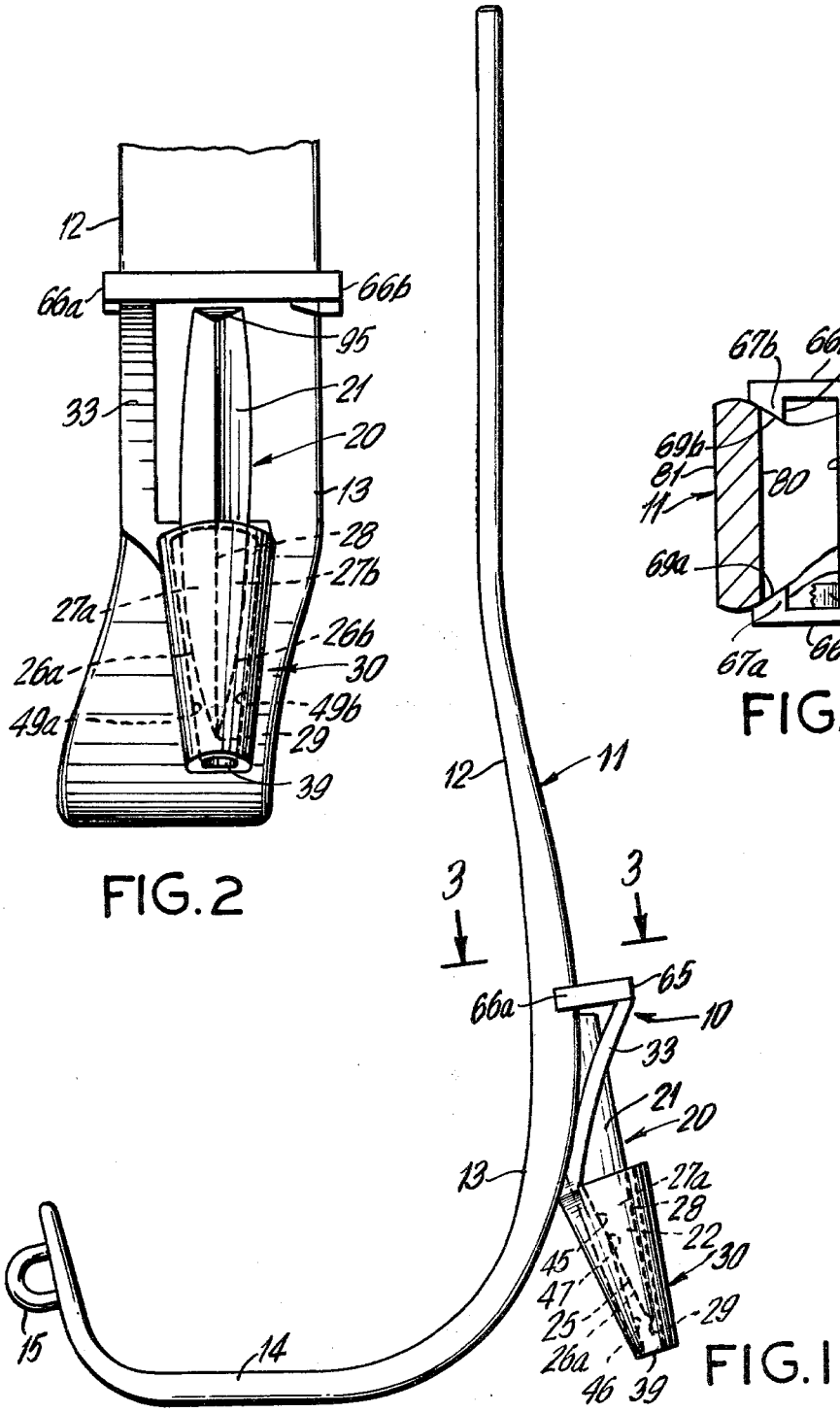
FIG. 1

GAFF GUARD FOR LINEMEN'S CLIMBERS

TECHNICAL FIELD

This invention relates to guards for protecting the gaffs on climbers used by linemen to climb telephone poles or power poles.

BACKGROUND OF THE INVENTION

In the telephone and electric utility industries, cables and other items on wooden poles are installed, maintained and repaired by linemen (male or female) who climb the poles by the use of climbers strapped to their boots and legs. Such climbers consist of leg irons to which are secured sharp gaffs which are dug into the wood of the pole by a lineman to thereby permit him to ascend the pole or to descend it. Both to prevent injury to personnel by the gaffs and to preserve the sharpness of their cutting edges, it is desirable that climber gaffs when not in use be protected by guards.

U.S. Pat. No. 2,870,947 issued Jan. 27, 1959 to A. R. Hendry discloses for those purposes a gaff guard comprising a body composed of rubber or of certain types of plastics, such body being in the form of a slipper. The toe of the body has formed therein a socket for receiving the gaff, such socket being reinforced by a metallic tubular triangular cross-sectional insert embedded in the material of the body to be separated from the socket cavity by a layer of such material forming the inner wall of such cavity. The heel of the body provides means for mounting the guard on the leg iron of the climber. In one embodiment, such mounting means consists of a pair of strap portions disposed on transversely opposite sides of the heel and adapted to fold around the leg iron and then lock together at their ends by the expedient of a dove tail joint which such ends are shaped to form. In another embodiment, such mounting means is a metallic clip member having a base embedded in the material of such body and having, also, a pair of spring arms projecting outwards from transversely opposite sides of such base and adapted to engage transversely opposite sides of the leg iron.

The described Hendry gaff guard is wasteful of material and is not likely to be durable or rugged in use. Further, since the portion of the slipper shaped guard which joins its toe and heel is disposed in use on the outside of the gaff and is thus fully exposed to blows, the guard is subject to being very easily dislodged. Still further, the guard offers no way for avoiding dulling of the cutting edges of the gaff by dirt and grit accumulating in the socket of the guard or corrosion of the gaff and its cutting edges by water accumulated and retained therein.

Other gaff guards known to the prior art are disclosed in U.S. Pat. No. 2,497,710 issued Feb. 14, 1950 in the name of C. N. Wollensack and in U.S. Pat. No. 1,931,823 issued Oct. 24, 1933 to G. E. Hushour.

SUMMARY OF THE INVENTION

It is accordingly an object of the invention to provide gaff guards which are inexpensive, rugged in any particular use and, also, durable to have long, useful lives.

Another object of the invention is to provide gaff guards easily securable to a climber while relatively insusceptible to dislodgement therefrom during handling and storage, yet can be readily and easily removed when desired, even when the climber is strapped to the boot.

Still another object of the invention is to provide gaff guards adapted to minimize dulling of the gaff cutting edges.

Another objective is to cushion incidental blows, as would occur should the climber be dropped, so as to avoid the gaff tip from being deformed or otherwise damaged.

These and other objects are realized according to the invention by providing a gaff guard comprising a body of synthetic resinous material having parts comprising a scabbard having a longitudinally elongated hollow interior for receiving the point of the gaff, a clip adapted to straddle transversely opposite sides of the leg iron at a location above the gaff and to there attach by a snap-on action to such leg iron, and a resilient stem coupling the clip and scabbard together in fixed spatial relation when the stem is resiliently unstressed. The clip comprises, an arm longitudinally spaced from and disposed transversely of the scabbard, a pair of prongs joined to the arm on transversely opposite sides of the centerline of said interior and projecting rearward of said arm, and a pair of tabs each joined rearward of said arm to a respective one of said prongs and projecting therefrom inwardly towards each other to be disposed to make contact with the back face of the iron upon attachment thereto of the clip. The stem is connected to the clip arm by a junction thereof and to the scabbard by a junction of the stem and scabbard disposed inwards of the outer side of the scabbard. Those two junctions are transversely offset to the same side from the mentioned centerline to permit the stem to extend between the clip and scabbard to one transverse side of the base of the gaff.

Guards of the kind just described may be inexpensively made and are rugged and durable. The resilience of parts of the guard may be utilized to provide for convenience in use of the guard and effect frictional engagement of the guard with the iron. Due to the stem of the guard being disposed in use to one transverse side of the base of the gaff rather than on the outside of it, the stem is relatively immune to receiving blows tending to dislodge the guard from the leg iron. Other advantages of a guard of such kind will become apparent from the disclosure which follows.

BRIEF DESCRIPTION OF THE DRAWINGS

For a better understanding of the invention, reference is made to the following description of a representative embodiment thereof and to the accompanying drawings wherein:

FIG. 1 is a side elevation of an assembly of a climber and of a gaff guard according to the invention, the clip of the guard not being attached to the climber;

FIG. 2 is a front elevation of the assembly of FIG. 1 with the top of the climber being broken away;

FIG. 3 is a view in cross section of a portion of the FIG. 1 assembly, such view being taken as indicated by the arrows 3—3 in FIG. 1;

DETAILED DESCRIPTION OF STRUCTURAL ASPECTS

Figure 4:
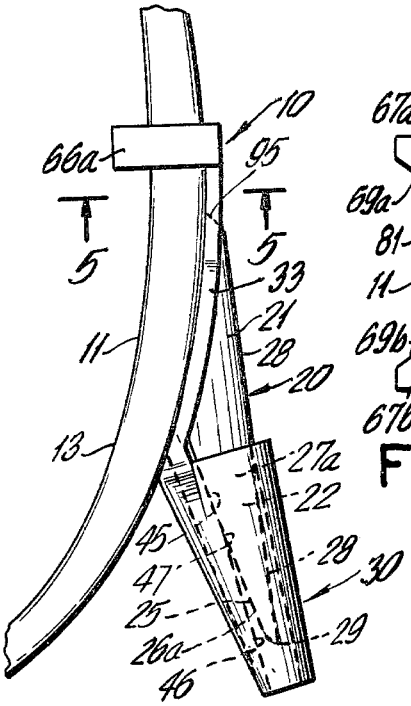
FIG. 4 is a side elevation the same as that of FIG. 1 except that parts of the climber are broken away, and the clip of the guard is shown attached to the climber.

Referring now to FIG. 1, the reference number 10 generally designates a lineman's climber comprising a leg iron 11 having a shank 12 connected by a bend portion 13 to a stirrup 14 on which is an outwardly facing eye called a ring loop 15. Another part of the climber is provided by a gaff 20 having its rear part or base 21 secured by a rivet (not shown) to leg iron 11 at the top of bend portion 13 such that the forward part 22 of the gaff projects downwardly and outwardly from leg iron 11 when the iron is upright. In use, climber 10 is secured to one of the boots of a lineman by lower and upper straps, the lower strap being attached by a ring to the ring loop 15, and the upper strap being coupled through an adjustable sleeve to the top of the climber, none of such straps, ring and sleeve being shown in FIG. 1 but all being well known. Two such climbers on the two boots of the lineman are used by him (or her) for climbing poles.

The forward part or point 22 of the gaff 20 has an inner face 25 joined by transversely opposite inner edges 26*a*, 26*b* FIG. 2 to two outer faces 27*a*, 27*b* in turn joined to single outer edge 28, those three faces and three edges all converging to a gaff tip 29. Outer faces 27 are slightly convex whereas inner face 25 is flat except near and at tip 29 where it is ground to curve toward outer edge 28. As a result, the forward part or "point" of the gaff has a triangular "beehive" cross section in planes normal to its longitudinal axis. Outer edge 28 is straight, and is not sharpened, but inner edges 26 near and at tip 29 are extremely sharp to permit the tip to dig effectively into the wood of a pole. Evidently, it is important for the lineman's safety that the sharpened portions of edges 26 be protected from inadvertent dulling by coming into contact with stones, grit, dirt or like, and it is equally important for safety's sake that the lineman and others be protected from being cut by those sharp edges when the lineman's climbers are detached from his boots. Both such kinds of protection are provided by a gaff guard according to the present invention.

Figure 6:
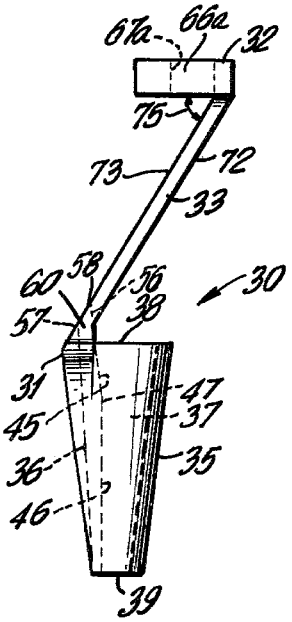
FIG. 6 is a side elevation of the gaff guard alone.
Figure 7:
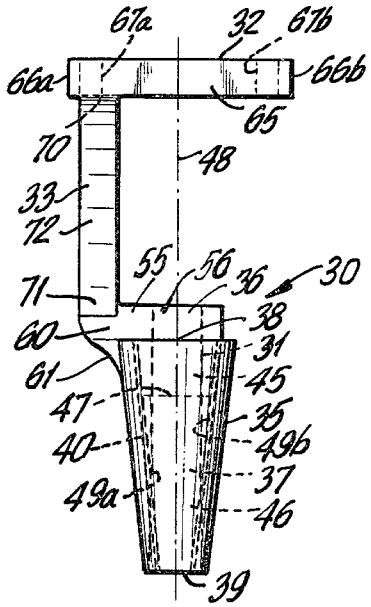
FIG. 7 is a front elevation of the guard of FIG. 6.
Figure 8:
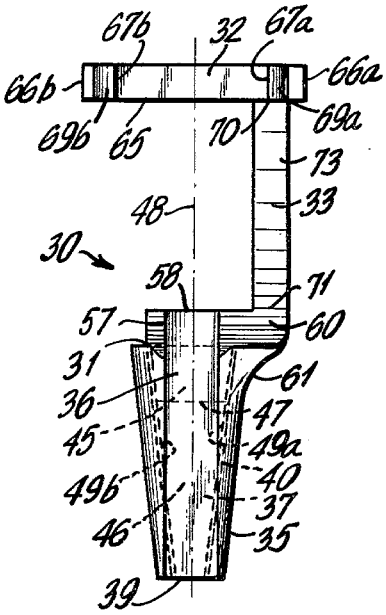
FIG. 8 is a rear elevation of the guard of FIG. 6.

The details of such guard are best shown in FIGS. 6–8. Referring to those figures, the reference numeral 30 generally designates a gaff guard consisting of a single body of synthetic resinous material comprising as parts thereof of a scabbard 31, a clip 32 and a resilient stem 33 coupling elements 31 and 32 together.

Scabbard 31 includes a sheath 35 having an exterior generally of frustro-conical shape of convergent taper in the downward direction. However, such exterior on the rear side of the sheath is flat and has formed therein a recessed grove 36 for purposes of saving material, reducing molding time and maintaining the dimensional integrity of the interior surfaces 45 and 46.

Sheath 35 has a longitudinally elongated hollow interior 37 extending entirely through the sheath from a top opening 38 permitting the gaff point to enter the sheath to a bottom opening 39 permitting water, dirt or grit to discharge from interior 37 and thus not accumulate therein. Interior 37 is bounded by an inner wall 40 which for the most part is frusto-conical in shape and has a convergent taper in the downward direction, such taper being less in such direction than is the taper of the gaff point. On the inner side of the guard, however, the surface of wall 40 consists of first and second longitudinally displaced flats 45, 46 joining each other at a transverse edge 47, the result being that interior 37 has a cross-section in planes normal to its centerline 48 a configuration corresponding to that of a circle having a segment thereof cut off on the inner side of the guard. As shown, flats 45, 46 are convergently tapered downward and meet with the frustro-conical inner wall at edges 49*a*, 49*b*. Flat 45 is inclined at a greater angle to centerline 48 than is flat 46 such that the two flats define an obtuse angle in a plane normal to edge 47, such edge being at the vertex of that angle. The flats 45 and 46 form together for interior 37 a wall surface longitudinally coextensive therewith. Such surface is contoured between the longitudinal ends thereof to be displaced towards centerline 48 from a chord (not shown) joining these two ends, and to have a maximum such displacement at a location (corresponding to that of edge 47) intermediate the top opening 38 of interior 37 and the midpoint of the longitudinal extent thereof. A wall surface of such contour is useful in guard 30 as later explained and, while shown as provided by two flats, may also be provided by one or more curved surfaces or one flat and one or more curved surfaces.

Scabbard 31 also includes as a part thereof a transverse rib 55 on the inner side of the scabbard and longitudinally projecting therefrom outwards of the sheath 35. Rib 55 has (a) a front face 56 in substantially the same plane as flat 45, and (b) a slanting rear face 57 meeting face 56 to form at the top of the rib a transverse ridge 58. Faces 56 and 57 thus form a dihedral angle substantially corresponding to the dihedral angle formed by the inner face 25 of the gaff 20 and the surface opposite of leg iron 11 at the crotch on the inner face 25 of the gaff where it and the leg iron meet. Rib 55 on one transverse side of the guard has a stub portion 60 extending outward beyond sheath 35 to be transversely salient therefrom. Stub portion 60 is strengthened by a faired corner 61 joining the underside of such portion to the side of sheath 35 at a location below the top opening 38 thereof.

Turning now to clip 32, it consists of an arm 65 longitudinally spaced from and disposed transversely of scabbard 31, a pair of resilient prongs 66*a*, 66*b* (FIG. 3) joined to the ends of arm 65 on transversely opposite sides of centerline 48, and a pair of tabs 67*a*, 67*b* joined rearward of arm 65 to, respectively, prongs 66*a*, 66*b* at the free ends thereof. As shown, tabs 67 project from their respective prongs 66 inwardly (FIG. 5) towards each other to be disposed to make contact with the back face of leg iron 11 upon attachment of the clip thereto. Preferably, such contact is an areal contact made by transversely aligned faces 68*a*, 68*b* on the sides of the tabs towards arm 65, but it may also be a line contact made by transversely aligned edges on such sides of the tabs, or, less preferably, a point contact made between such tabs and such back face.

To the end of implementing attachment of the clip to the leg iron, tabs 67*a*, 67*b* have formed on the inner ends thereof frontwardly presented respective wedging faces 69*a*, 69*b* whose operation will be later described.

Arm 65 of clip 32 is (FIGS. 7 and 8) connected to the top of resilient stem 33 at a junction 70 thereof transversely offset from centerline 48. The bottom of the stem is connected to scabbard 31 by a junction 71 thereof transversely offset from centerline 48 to the same side thereof as is junction 70, and, moreover, disposed inwards of the outer side of the scabbard. More specifically, such junction 71 is between stem 33 and the transversely salient stub portion 60 of the scabbard.

Stem 33 is resiliently bendable under applied force in the direction between the front face 72 and rear face 73 of the stem. At the same time, stem 33 is sufficiently stiff to couple clip 32 and scabbard 31 together in spatially fixed relation when the stem is resiliently unstressed. The faces 72, 73 of stem 33 have a width in the transverse direction greater than the thickness of the stem between those faces. As a result, stem 33 is more resilient in that thickness direction than it is in the transverse direction.

At the arm 65 of clip 32, stem 33 defines with the prongs 66 of the clip an angle 75 which preferably (but not necessarily) is one which, while approaching a right angle, deviates to an extent from it when the clip is unattached to the leg iron. Thus, as shown in FIG. 6, for example, such angle 75 approaches a right angle but is, as preferred, an acute angle. Such angle may less preferably, however, be an obtuse angle approaching a right angle or, alternatively, a right angle.

USE OF THE GUARD

The described guard 30 is used with the climber 10 in a manner as follows. Assuming that the guard is originally wholly detached from the climber, guard 30 is put into use by first slipping scabbard 31 over the point 22 of gaff 20 such that (FIG. 1) the gaff point 22 is received into the hollow interior 37 of the scabbard with the guard rib 55 being fitted into the crotch between the inner face 25 of the gaff and the opposite surface of the leg iron. In such initial position, the wedging faces 69 (FIG. 3) of the guard clip 32 contact transversely opposite sides of the front face 80 of leg iron 11 at a location on the leg iron above gaff 20 to produce in stem 33 (FIG. 1) an outward or reverse curvature. The resilient stress thereby produced in the stem maintains faces 69 in pressure contact with face 80 to thereby cause between the guard and the climber a frictional engagement which tends to hold the guard in its initial position on the climber.

If rib 55 is not fully advanced into the mentioned crotch, there may be some angular play between scabbard 31 and gaff point 22. If such play exists, inner face 25 of the gaff may make areal contact, with flat 45 on the inside of the scabbard (see FIG. 1). Alternatively, such face 25 may make line contact with edge 47 inside the scabbard while the gaff's outer edge 28 makes contact at scabbard top opening 38 with inner wall 40 of the scabbard interior (see FIG. 4) to thereby cause gaff point 22 to be restrained by those two contacts from further angular movement clockwise relative to the inner wall 40. In either case and because of the heretofore described contour of the inner wall surface formed by flats 45 and 46, the tip 29 of gaff point is held displaced away in the front to rear direction from the flat 46 such that the gaff cutting edges 26 near and at tip 29 cannot contact that flat and thus possibly be dulled by dirt or grit deposited thereon. When rib 55 is fully advanced into the crotch to bear on opposite sides against, respectively, the gaff and the leg iron, gaff face 25 makes areal contact with flat 45, gaff edge 28 contacts inner wall 40 as described above, angular play in the front to rear direction between the scabbard and gaff point is substantially eliminated, and the gaff cutting edges 26 are held in a stable manner away from flat 46.

With the guard 30 being in its initial or FIG. 1 position, in the presence of a force tending to move the guard angularly or translationally in the transverse direction relative to the climber 10, the pressure contact of the clip's wedging faces 69 on the leg iron creates frictional counter-forces resisting such movement of the guard. Also, the frustro-conical inner wall surface 40 of scabbard interior 37 is close to perpendicular with flats 45, 46 (in planes normal to centerline 48) near the edge intersections **49*a*, 49*b* of that surface with those flats, and it follows that, if gaff point 22 were to attempt to move translationally or angularly in the transverse direction relative to scabbard 31, such surface would be contacted by the rear portion of one or the other of gaff edges 26 to restrict such movement to an amount for which the forward sharp portions of the contacting edges 26 would not yet have borne against the scabbard inner wall 40 to possibly be dulled by dirt or grit thereon. Moreover, when rib 55 is fully fitted into the gaff leg iron crotch, the contact of the rib with the climber over the transverse extent of the crotch inhibits such movement. Accordingly, for any one or more of those reasons, guard 30** even when its initial position protects the cutting edges of the gaff from dulling.

Figure 5:
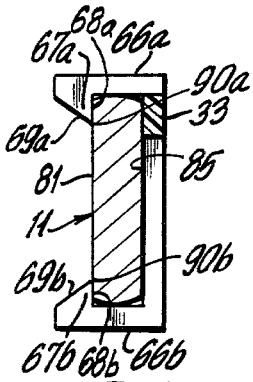
FIG. 5 is a view in cross section of a portion of the assembly shown in FIG. 4, such view being taken as indicated by the arrows 5—5 in FIG. 4.

The disposition of the guard on the climber is changed from that shown in FIG. 1 to that shown in FIG. 4 by applying forward hand pressure to the arm 65 of the clip. Responsive to that hand pressure if applied to the transverse center of arm 65, the wedging faces 69 on tabs 67 of clip 32 react (FIG. 3) with the transversely opposite sides of leg iron 11 to produce a transverse resilient spreading apart of prongs 66 to the point where the tabs 67 straddle the leg iron and then pass by it in the course of the forward movement undergone by the clip 32 because of the hand pressure. Once the tabs have passed the leg iron, the resilient prongs snap back towards each other to dispose the tabs 67 behind the back face 81 of the leg iron (FIG. 5).

In such connection, while the distance between the front face 85 of clip arm 65 and the faces 68 of the tabs is equal or slightly greater than the thickness of the leg iron, because of the acute angle defined between stem 33 and prongs 66 and the resultant inclination of such distance relative to the thickness dimension of the iron, the tabs would not, without more, have enough "reach" to get behind the back face of the leg iron when forward movement of the tabs is stopped by contact of arm 65 with the front face 80 of the leg iron. In the described guard however, the resilient spreading apart of prongs 66 stores up energy therein producing between the inner tips **90*a*, 90*b* of tabs 67 and the curvature of the back halves of the transversely opposite sides of leg iron 11 a wedging action causing, more or less concurrently, (a) the mentioned acute angle to approach closer to a right angle to the point where such tabs can be driven in behind the leg iron, and (b) a driving in of such tabs behind the iron. Such expansion of that acute angle is caused by a relative resilient bending of the prongs 66 and stem 33 and by resilient twisting of arm 65, wherefore, once tabs 67 are inserted behind the back face 81 of the leg iron, they bear against that face with force induced by the resilient stress present because the angle between the stem and prongs remains greater then the value it had before the clip was attached to the leg iron. Accordingly, the clip 32 does not fit loosely on the leg iron but frictionally engages with it to tend to hold guard 30 longitudinally fixed in position on leg iron 11**.

Such frictional engagement may be in the form of areal contact between the transversely aligned faces 68 of the tabs and the back face of the leg iron, or such engagement may be in the form of line contact between such back face and the transversely aligned tab edges by which tab faces 68 are bordered on the sides thereof towards the scabbard.

By virture of the tendency of the described expanded acute angle to contract back to its original value under the resilient stress produced in the guard structure by the expansion of that angle, the clip 32 is adapted to frictionally engage with leg irons of thickness which vary in size between the limits that the thickness, on the one hand, is small enough to permit insertion of the tabs, behind the back face of the leg iron and, on the other hand, is large enough that the tabs will engage with such back face before all such resilient stress has been relieved by contraction of such angle back to original value. The same frictional gripping by the clip of the leg iron can be obtained by a resiliently modifiable angle between prongs 66 and stem 33 which is obtuse rather than acute but, where such angle is obtuse it will contract from its original value until the tabs become inserted behind the leg iron and, thereafter, will tend to expand back to its original value under the resilient stress produced in the guard structure by its initial contraction.

Besides being capable as described of accommodating legs irons of different thicknesses, the clip is also capable of frictionally gripping leg irons which differ in transverse width between the limit, on the one hand, that such width not be substantially greater then the distance between prongs 66 when resiliently undeflected and the limit, on the other hand, that such width be not less than the distance between the tips 90 of the tabs 67.

As so far described, the attachment of clip 32 to the iron involves a resilient deflection outward of both of prongs 66. In practice however, the clip can also be attached by merely hooking one prong and associated tab around one transverse side of the iron (the clip arm 65 thereon becoming tilted in relation to the leg irons front face 80, with the wedging face of the other tab contacting such face 80 as before described), and by then applying forwardly directed hand pressure to arm 65 at its end carrying the other prong so as, in the manner before described, to force the tab on that prong to the back side of the leg iron and then become inserted behind the back face of the leg iron to frictionally grip it. When such technique is used, the wedging face 69 on the tab 67 hooked around the leg iron performs no useful function and can be dispensed with, and, moreover, the prong to which that tab is joined need not be resiliently deflectable for purposes of attaching the clip to the leg iron.

In the course of attachment of the clip to the leg iron, the stem 33 is displaced forward such that the stem becomes resiliently deflected and assumes the forward curvature shown in FIG. 4. Because of the resilient stress induced in the stem by the deflection, the stem exerts on clip 32 an outward force which would cause the clip's tabs 67 to frictionally engage with the back face of the leg iron even if the clip were to be loose fitting on the iron. Also the forward displacement of the stem 33 and resulting resilient stressing thereof results in the exertion on the scabbard of an outward force tending to increase the pressure contact between the bounding wall of the scabbard's interior and the inner face 25 of the gaff point and, thereby, to more firmly maintain such gaff point disposed within that interior such that the gaff cutting edges do not touch the inner wall surface thereof.

Also the above described outward force resultant from the resilient bending of stem 33 aids in the removal of the clip 32 from the leg iron 11 in that when the tabs 67 are moved from the back face 81 of the iron by finger pressure toward the front face 80, the tabs 67 tend to move toward and retain the resiliently unstressed position (FIGS. 1 and 3) on the transverse sides of front face 80 of the leg iron.

Because of the transverse offset of stem 33 from the centerline 48 of the scabbard interior and because, further, the stem is connected to the scabbard inwards of the outer side thereof, the stem 33 is, as shown in FIG. 4, enabled upon attachment of clip 32 to lie to one transverse side of the gaff base so as, over the length of the stem, to either contact the front face of the leg iron or be in close proximity thereto. Such disposition of the stem to "hug" the leg iron has the advantage, among others, that the stem is well protected from a dislodgement thereof by blows which might cause dislodgement of the entire guard from the climber.

Securement of the guard to the climber as described is convenient because it requires neither much skill nor much strength and thus can as readily be done by female linemen as male linemen. When the guard is locked securely to the climber as shown in FIG. 4, upward movement of the guard on the climber will be stopped by contact of the rib 55 of the guard with the gaff and leg iron of the climber and, conversely, downward movement of the guard on the climber will be stopped by contact between the arm 65 of the clip and the outwardly projecting upper end 95 of the base of the gaff. Thus, even if the frictional grip of the clip 32 on the leg iron is overcome to produce slipping movement of the guard relative to the climber, such movement can only occur between two limits, and any such limited movement will not be enough to remove the cutting edges of the gaff from the protection thereto offered by the scabbard. When guard 30 is secured to the climber in the manner shown in FIG. 4 those cutting edges will be prevented from touching the inner wall of scabbard interior 37 in the same ways as were described in connection with FIG. 1 excepting that, with the clip 32 now being lockingly attached to and frictionally gripping the leg iron, the guard is now even more firmly held against translatory or angular movement transversely relative to the climber.

Since the described guard is wholly constituted of a single body of synthetic resinous material it is inexpensive to manufacture, mechanically rugged, insusceptible to rusting or other corrosion, and otherwise extremely durable. Also, since it contains no metal which might contact the climber, the guard cannot produce deformation, abrasion or rusting or other corrosion of parts of the climber by metal-to-metal contact therewith. The guard may be removed from the climber with the employment of a minimum of skill and force by using the fingers to push or pull one of the tabs 67 of clip 32 out from behind the leg iron 11 and then to the front thereof, unhooking the other tab from the leg iron to detach clip 32 therefrom, and then slipping the scabbard 31 off the point of the gaff.

DETAILS OF CONSTRUCTION

The guard is made by molding of synthetic resinous material. Suitable material for the guard is available from Premium Plastics Inc. 250 Forrest Street, Metuchen, N.J. 08840 under the name of "Copolymer Polypropylene CP-2013, Yellow", that material comprising polypropylene modified with other materials to prevent the resin from becoming brittle at low temperatures, ultraviolet light stabilizers and coloring matter. Another material suitable for the guard is that known in the trade as "AMOCO 6011" which is a copolymer polypropylene available from the AMOCO Chemical Corporation. Overall dimensions for the guard are about $3\frac{5}{8}$" from the top of clip 32 to the bottom of scabbard 31 and about $1\frac{5}{8}$" for the width of clip arm 65.

The above described embodiment being exemplary only, it will be understood that additions thereto, omissions therefrom and modifications thereof may be made without departing from the spirit of the invention. For example, if desired, the guard may include a second stem similar to stem 33 and disposed symetrically therewith in relation to centerline 48, such stem being coupled to an additional scabbard stub portion similar to stub portion 60 but disposed transversely opposite it. Further, while the guard preferably consists of nothing more than a single body of synthetic resinous material, it can, if a need arises, incorporate one or more parts of a different material than its main body, and such body may be constituted of two or more originally separate parts.

Accordingly, the invention is not to be considered as limited save as is consonant with the following claims.

What is claimed is:

1. A guard for the gaff of a lineman's climber having a leg iron to which said gaff is secured, said guard comprising a body of synthetic resinous material having parts comprising, (a) a scabbard having a longitudinally elongated hollow interior for receiving the point of said gaff, (b) a clip adapted to straddle transversely opposite sides of said leg iron at a location above said gaff and to there attach by a snap-on action to said leg iron, said clip comprising an arm longitudinally spaced from and disposed transversely of said scabbard, a pair of prongs joined to said arm on transversely opposite sides of the centerline of said interior and projecting rearward from said arm, and a pair of tabs each joined rearward of said arm to a respective one of said prongs and projecting therefrom inwardly towards each other to be disposed to make contact with the back face of said leg iron upon attachment thereto of said clip, and (c) a resilient stem coupling said clip and scabbard together in fixed spatial relation when said stem is resiliently unstressed, said stem being connected to said arm by a junction thereof and to said scabbard by a junction of said arm and scabbard inwards of the outer side of said scabbard, and said junctions being transversely offset to the same side from said centerline to permit said stem to extend between said clip and scabbard to one transverse side of the base of said gaff.

2. A guard according to claim 1 in which said scabbard comprises (a) a sheath having said hollow interior, and (b) a transverse rib projecting at the inner side of said scabbard longitudinally outwards from said sheath.

3. A guard according to claim 1 or claim 2 in which said scabbard has a transversely salient stub portion, and said stem is connected with said scabbard by a junction of said stem with said stub portion.

4. A guard according to claim 1 in which said hollow interior of said scabbard is bounded on the inner side thereof by a wall surface longitudinally coextensive with said interior, and in which said surface is contoured between the longitudinal ends thereof to be displaced towards said centerline from the chord joining said ends of said surface and to have a maximum such displacement at a location intermediate the end of said interior at the opening thereof towards said clip and the midpoint of the longitudinal extent of said interior.

5. A guard according to claim 4 in which said surface comprises first and second longitudinally displaced flats together defining an obtuse angle having its vertex at said location.

6. A guard according to claim 1 in which, said arm is joined to said prongs and to said stem such that said prongs and said stem define a resiliently modifiable angle which is other than a right angle when said clip is detached from said leg iron.

7. A guard according to claim 6 in which said angle defined by said prongs and stem is an acute angle when said clip is detached from said leg iron.

* * * * *